US006385787B1

(12) United States Patent
VanVoorhies

(10) Patent No.: US 6,385,787 B1
(45) Date of Patent: May 14, 2002

(54) TANK FILL AND DISCHARGE MECHANISM

(76) Inventor: Kurt L. VanVoorhies, P.O. Box 308, De Tour Village, MI (US) 49725

( * ) Notice: Subject to any disclaimer, the term of this patent is extended or adjusted under 35 U.S.C. 154(b) by 0 days.

(21) Appl. No.: 09/630,395

(22) Filed: Aug. 2, 2000

Related U.S. Application Data

(60) Provisional application No. 60/146,884, filed on Aug. 2, 1999.

(51) Int. Cl.[7] ..... E03D 1/18
(52) U.S. Cl. ..... 4/333; 4/366
(58) Field of Search ..... 4/333, 338, 339, 4/366, 381, 382, 383, 384

(56) References Cited

U.S. PATENT DOCUMENTS

| | | | | |
|---|---|---|---|---|
| 299,606 A | | 6/1884 | Weeden | 4/333 |
| 348,682 A | | 9/1886 | McArdell | 4/333 |
| 590,944 A | | 9/1897 | Crowell | 4/333 |
| 672,468 A | | 4/1901 | Wilkes | 4/333 |
| 672,469 A | | 4/1901 | Wilkes | 4/333 |
| 872,935 A | | 12/1907 | Harman | 4/333 |
| 909,638 A | | 1/1909 | Morgan | 4/333 |
| 961,458 A | | 6/1910 | Morgan | 4/333 |
| 1,000,728 A | | 8/1911 | Furst et al. | 4/333 |
| 1,028,198 A | | 6/1912 | Dulles | 4/333 |
| 1,078,797 A | | 11/1913 | Moise | 4/333 |
| 1,174,123 A | | 3/1916 | Christensen | 4/333 |
| 1,283,058 A | | 10/1918 | Boursier | 4/333 |
| 1,377,712 A | * | 5/1921 | Lewis | 4/381 |
| 1,386,948 A | | 8/1921 | Renner | 4/333 |
| 1,508,098 A | | 9/1924 | Hastrich | 4/333 |
| 1,516,043 A | | 11/1924 | Hughes | 4/333 |
| 1,543,799 A | | 6/1925 | Segato | 4/333 |
| 1,568,994 A | | 1/1926 | Norbork | 4/333 |
| 2,658,520 A | | 11/1953 | Ribeiro | 137/391 |
| 2,882,533 A | | 4/1959 | Gray | 4/334 |
| 2,971,201 A | | 2/1961 | Kurkoske | 4/333 |
| 3,082,433 A | | 3/1963 | Armstrong et al. | 4/333 |
| 3,095,577 A | | 7/1963 | Clark | 4/333 |
| 3,296,629 A | | 1/1967 | Clark | 4/333 |
| 3,296,630 A | | 1/1967 | Clark | 4/333 |
| 4,601,071 A | | 7/1986 | Persson | 4/333 |

FOREIGN PATENT DOCUMENTS

| | | | | |
|---|---|---|---|---|
| DE | 343676 | * | 11/1921 | 4/366 |
| DK | 36365 | * | 8/1926 | 4/333 |
| FR | 437097 | * | 3/1913 | 4/366 |
| GB | 27846 | * | 5/1907 | 4/366 |

* cited by examiner

*Primary Examiner*—Robert M. Fetsuga
(74) *Attorney, Agent, or Firm*—Kurt L. VanVoorhies

(57) ABSTRACT

An inlet valve and a discharge valve are operatively coupled by a coupling element so that when the discharge valve is closed, the inlet valve is open, and when the inlet valve is closed, the discharge valve is open. A biasing element biases the inlet valve closed. Upon closure of the discharge valve, a releasable retaining element retains the inlet valve open and the discharge valve closed against the action of the biasing element, thereby enabling the inlet valve to fill a tank with a fluid. A float responsive to the level of fluid in the tank engages and releases the retaining element when the tank is full, thereby enabling the biasing element to close the inlet valve and open the discharge valve, thereby discharging the fluid from the tank. In one aspect, the retaining element comprises a clamp mechanism that releasably clamps either the coupling element, the inlet valve, or the discharge valve. In another aspect, the coupling element comprises a rod in translation and the retaining element comprises a latch mechanism operatively coupled thereto.

44 Claims, 4 Drawing Sheets

TANK FILL AND DISCHARGE MECHANISM

CROSS-REFERENCE TO RELATED APPLICATIONS

The instant application claims the benefit of prior U.S. Provisional Application Serial No. 60/146,884 filed on Aug. 2, 1999, which is incorporated herein by reference.

TECHNICAL ART

The instant invention generally relates to mechanisms for filling and discharging fluid from a tank and more particularly to such discharge mechanisms that first add fluid to a tank and then discharge that fluid, leaving the tank discharged thereafter until the next fill and discharge cycle.

BACKGROUND OF THE INVENTION

A number of devices, including toilets, incorporate a means for discharging a metered volume of fluid, and for also metering the amount of fluid that will be discharged. In many of these devices, metered volume of fluid is held by a holding tank until such time as discharge means is activated for discharging the tank. By use of the holding tank, different fluid flow rates may be used for the filling and discharge processes. For example, with a toilet tank, the toilet tank is typically filled at a relatively slow rate and then discharged at a relatively fast rate for purposes of flushing the toilet, wherein the relatively fast rate of discharge is needed for effectively flushing the toilet bowl. In systems for which the holding tank is normally filled with fluid, the tank is in a state that is ready for discharge, so that the discharge process is responsive to the activation thereof, without substantial delay.

A number of problems are associated with tank discharge mechanisms for which the tank is normally filled with the fluid to be discharged. For example, a holding tank filled with cold fluid is subject to condensation on the outside of the tank. Further, the holding tank filled with fluid is subject to leakage and wastage if the discharge valve does not seal properly, as is common with many toilets, for example as a result of a sticking discharge handle or a problem with the chain linkage between the float and the discharge valve. Yet further, if the temperature of the fluid is substantially different from the surroundings, there can be substantial heat transfer with the surroundings during the period from when the time the tank is filled until when the tank is flushed. The temperature of the fluid in a normally filled tank will tend towards that of the surroundings, which if different from the initial temperature of the fluid can be a problem in systems for which the temperature of the discharge fluid is preferably the same as that of the initial temperature of the fluid.

SUMMARY OF THE INVENTION

In accordance with a first aspect, a tank filling and discharge mechanism comprises:

(a) an inlet valve comprising a housing, a valve seat, and a first valve element moveable relative to the valve seat for opening and closing the inlet valve, wherein the inlet valve is operatively coupleable to a tank and to a source of fluid, whereby when the inlet valve is operatively coupled to the tank and to the source of fluid, the inlet valve admits the fluid to the tank when the inlet valve is open;

(b) a discharge valve comprising a second moveable valve element, wherein the discharge valve is operatively coupleable to the tank, whereby when the discharge valve is operatively coupled to the tank, when the discharge valve is opened, the fluid can discharge from the tank through the discharge valve;

(c) a coupling element operatively coupled to the first moveable valve element of the inlet valve and to the second moveable valve element of the discharge valve so that when the discharge valve is closed, the inlet valve is open; and when the inlet valve is closed, the discharge valve is open;

(d) an activation element operatively coupled to at least one of the coupling element, the inlet valve, and the discharge valve, whereby when activated, the activation element causes the inlet valve to open and the discharge valve to close;

(e) a first biasing element operatively coupled to at least one of the inlet valve, the coupling element and the discharge valve, whereby the first biasing element applies a biasing force to close the inlet valve;

(f) a retaining element operatively coupled to at least one of the inlet valve, the coupling element, and the discharge valve, wherein the retaining element comprises a clamp mechanism that releasably engages the at least one of the inlet valve, the coupling element, and the discharge valve; and (g) a float, wherein the float is moveable relative to the coupling element; a position of the float is responsive to a fluid level in the tank; for the position below a first position, when the discharge valve is closed, the retaining element engages at least one of the inlet valve, the coupling element, and the discharge valve, so as to prevent the inlet valve from closing and the discharge valve from opening; for the position above the first position, the float engages the retaining element so as to cause the retaining element to release the at least one of the inlet valve, the coupling element, and the discharge valve, thereby enabling the first biasing element to close the inlet valve and open the discharge valve.

In accordance with a second aspect, a tank filling and discharge mechanism comprises:

(a) an inlet valve comprising a housing, a valve seat and a first valve element moveable relative to the valve seat for opening and closing the valve, wherein the inlet valve is operatively coupleable to a tank and to a source of fluid, whereby when the inlet valve is operatively coupled to the tank and to the source of fluid, the inlet valve admits the fluid to the tank when the inlet valve is open;

(b) a discharge valve comprising a second moveable valve element, wherein the discharge valve is operatively coupleable to the tank, whereby when the discharge valve is operatively coupled to the tank and the discharge valve is opened, the fluid can discharge from the tank through the discharge valve;

(c) a coupling element operatively coupled to the first moveable valve element of the inlet valve and to the second moveable valve element of the discharge valve so that when the discharge valve is closed, the inlet valve is open, and when the inlet valve is closed, the discharge valve is open, wherein the coupling element comprises a rod operatively coupled between the first valve element of the inlet valve the second valve element of the discharge valve, whereby the first and second moveable valve elements are moved by a translation of the rod;

(d) an activation element operatively coupled to at least one of the coupling element, the inlet valve, and the discharge valve, whereby when activated, the activation element causes the inlet valve to open and the discharge valve to close;

(e) a first biasing element operatively coupled to at least one of the inlet valve, the coupling element and the discharge valve, whereby the first biasing element applies a biasing force to close the inlet valve;

(f) a retaining element operatively coupled to the coupling element, wherein the retaining element comprises a latch mechanism operatively coupled between the rod and the housing of the inlet valve that releasably engages the coupling element;

(g) a float, wherein the float is moveable relative to the coupling element; a position of the float is responsive to a fluid level in the tank; for the position below a first position, when the discharge valve is closed, the retaining element engages the coupling element so as to prevent the inlet valve from closing and the discharge valve from opening; for the position above the first position, the float engages the retaining element so as to cause the retaining element to release the coupling element, thereby enabling the first biasing element to close the inlet valve and open the discharge valve.

In accordance with a third aspect, a method of filling a tank with fluid and then discharging the fluid from the tank comprises:

(a) controlling an inflow of a fluid from a source of fluid into a tank with an inlet valve;

(b) controlling a discharge of the fluid from the tank with a discharge valve;

(c) operatively coupling the inlet valve to the discharge valve so that when the discharge valve is closed, the inlet valve is open; and when the inlet valve is closed, the discharge valve is open;

(d) applying a biasing force so as to tend to close the inlet valve;

(e) closing the discharge valve, thereby causing the inlet valve to open by the coupling of the inlet valve to the discharge valve, thereby admitting the fluid to the tank;

(f) providing a clamping force so as to hold the discharge valve closed against the biasing force;

(g) modifying the clamping force responsive to a buoyancy force, whereby when a level of the fluid in the tank is above a threshold, the biasing force is sufficient to overcome the clamping force, thereby closing the inlet valve and opening the discharge valve; and (h) discharging at least a portion of the fluid from the tank through the discharge valve.

In accordance with a fourth aspect, a method of filling a tank with fluid and then discharging the fluid from the tank comprises:

(a) controlling an inflow of a fluid from a source of fluid into a tank with an inlet valve;

(b) controlling a discharge of the fluid from the tank with a discharge valve;

(c) operatively coupling the inlet valve to the discharge valve so that when the discharge valve is closed, the inlet valve is open; and when the inlet valve is closed, the discharge valve is open; whereby the inlet valve is opened and the discharge valve is closed by a translation of a coupling element in a first direction; and the inlet valve is closed and the discharge valve is opened by a translation of the coupling element in a second direction opposite to the first direction.

(d) applying a biasing force so as to tend to close the inlet valve;

(e) closing the discharge valve, thereby causing the inlet valve to open by the coupling of the inlet valve to the discharge valve, thereby admitting the fluid to the tank;

(f) providing a latching force so as to hold the discharge valve closed against the biasing force;

(g) modifying the latching force responsive to a buoyancy force, whereby when a level of the fluid in the tank is above a threshold, the latching force is released, thereby enabling the biasing force to close the inlet valve and open the discharge valve; and (h) discharging at least a portion of the fluid from the tank through the discharge valve.

DETAILED DESCRIPTION OF THE PREFERRED EMBODIMENT(S)

Figure 1:
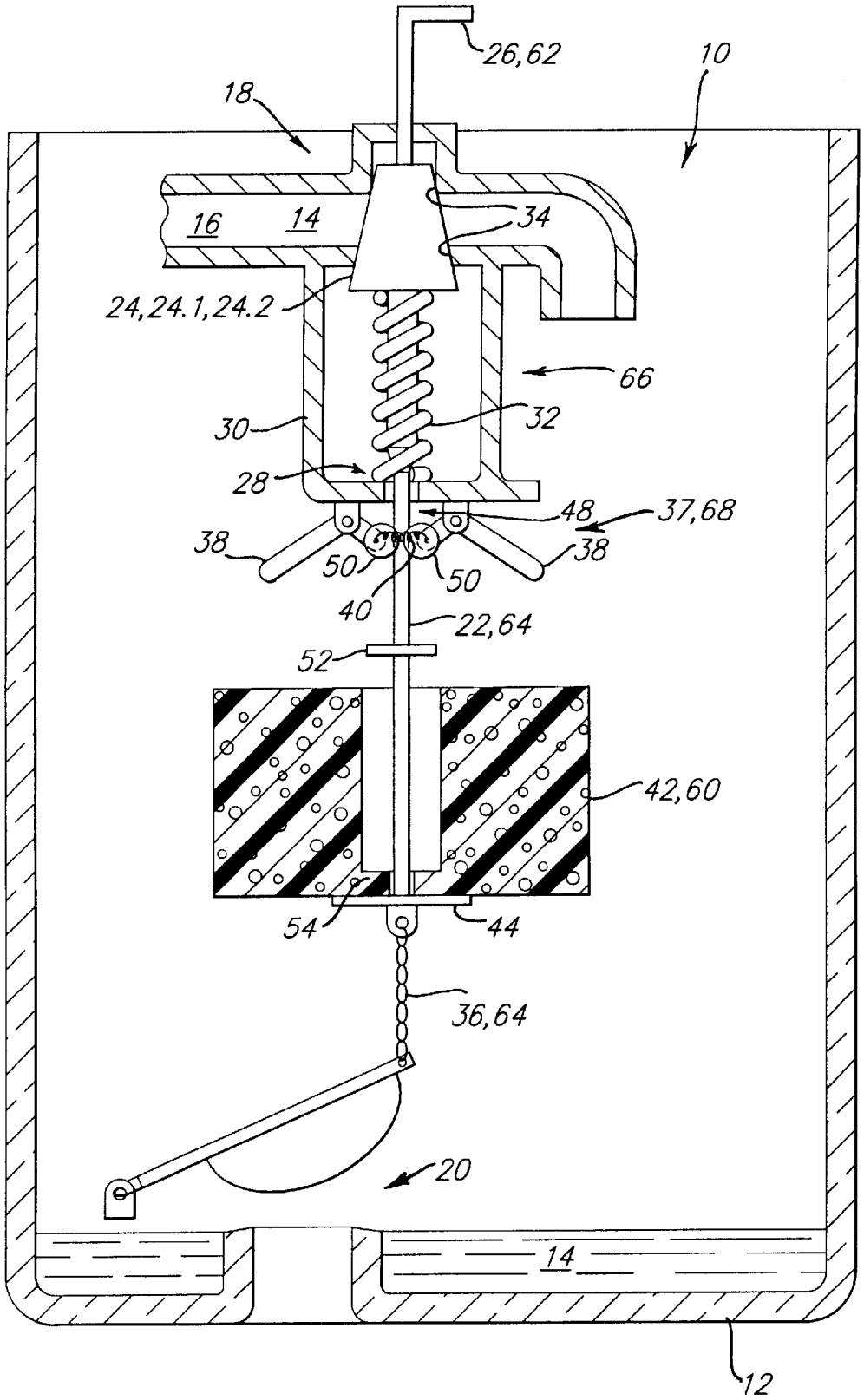
FIG. 1 illustrates a tank fill and discharge mechanism in a normally discharged tank, with a fluid inlet valve closed, a tank discharge valve open, and the tank discharged of fluid.

Referring to FIG. 1, a tank fill and discharge mechanism 10 that, when activated, fills a normally-discharged tank 12 with a fluid 14 from a source of fluid 16 through a normally closed fluid inlet valve 18 and automatically discharges the tank 12 of fluid 14 through a tank discharge valve 20 when the fluid level in the tank 12 reaches a predetermined level. FIG. 1 illustrates the tank 12 in a normally-discharged state with the fluid inlet valve 18 normally closed and the tank discharge valve 20 normally open.

The tank fill and discharge mechanism 10 comprises a rod 22 operatively coupled to a valve element 24 of the fluid inlet valve 18, for example a pintle 24.1 of a pintle valve, a gate 24.2 of a gate valve, or a ball of a ball valve. The rod 22 and the valve element 24 of the fluid inlet valve 18 are operatively coupled to a handle 26 for activating the inlet valve 18. In FIG. 1, for example, the handle 26 is shown directly coupled to one end of a pintle 24.1 of the fluid inlet valve 18, and the rod 22 is shown directly coupled to the other end of the pintle 24.1. Other arrangements for activating the inlet valve 18 are possible, as will be readily understood, for example a pushbutton or a handle mechanism. The rod 22 extends through an opening 28 in a housing 30 attached to or a part of the fluid inlet valve 18. A first biasing spring 32 operative between the pintle 24.1 and the housing 30 biases the pintle 24.1 against the seat 34 of the fluid inlet valve 18 so as the bias the fluid inlet valve 18 in a normally closed position. A normally open tank discharge valve 20 is operatively coupled to the rod 22, for example by a chain 36 or cable, such that the tank discharge valve 20 is held open by the chain 36 when the pintle 24.1 is positioned to close the fluid inlet valve 18 and the rod 22 is raised. When the fluid inlet valve 18 is opened, the rod 22 is lowered, thereby slackening the chain 36, enabling the tank discharge valve 20 to close responsive to gravity. A clamp mechanism 37 is operatively coupled between the rod 22 and the housing 30 to releasably engage the rod 22 against the biasing force of the first biasing spring 32 at a position that holds the fluid inlet valve 18 open and the tank discharge valve 20 closed. For example, a set of pawls 38—or at least one pawl 38—are operatively coupled to the rod 22 and are biased by at least one second biasing spring 40 so as to engage the rod 22, thereby restraining motion thereof in the direction that both closes the fluid inlet valve 18 and opens the tank discharge valve 20, while enabling motion of the rod 22 in the opposite direction. A float 42 disposed about the rod 22 is free to move in a direction along the axis of the rod 22 responsive to the fluid level in the tank 12. The rod 22 is provided with a first flange 44 upon which the float 42 rests when the tank 12 is discharged, so that the float 42 does not disrupt or become entangled with the tank discharge valve 20 or the chain 36 attached thereto.

Figure 2:
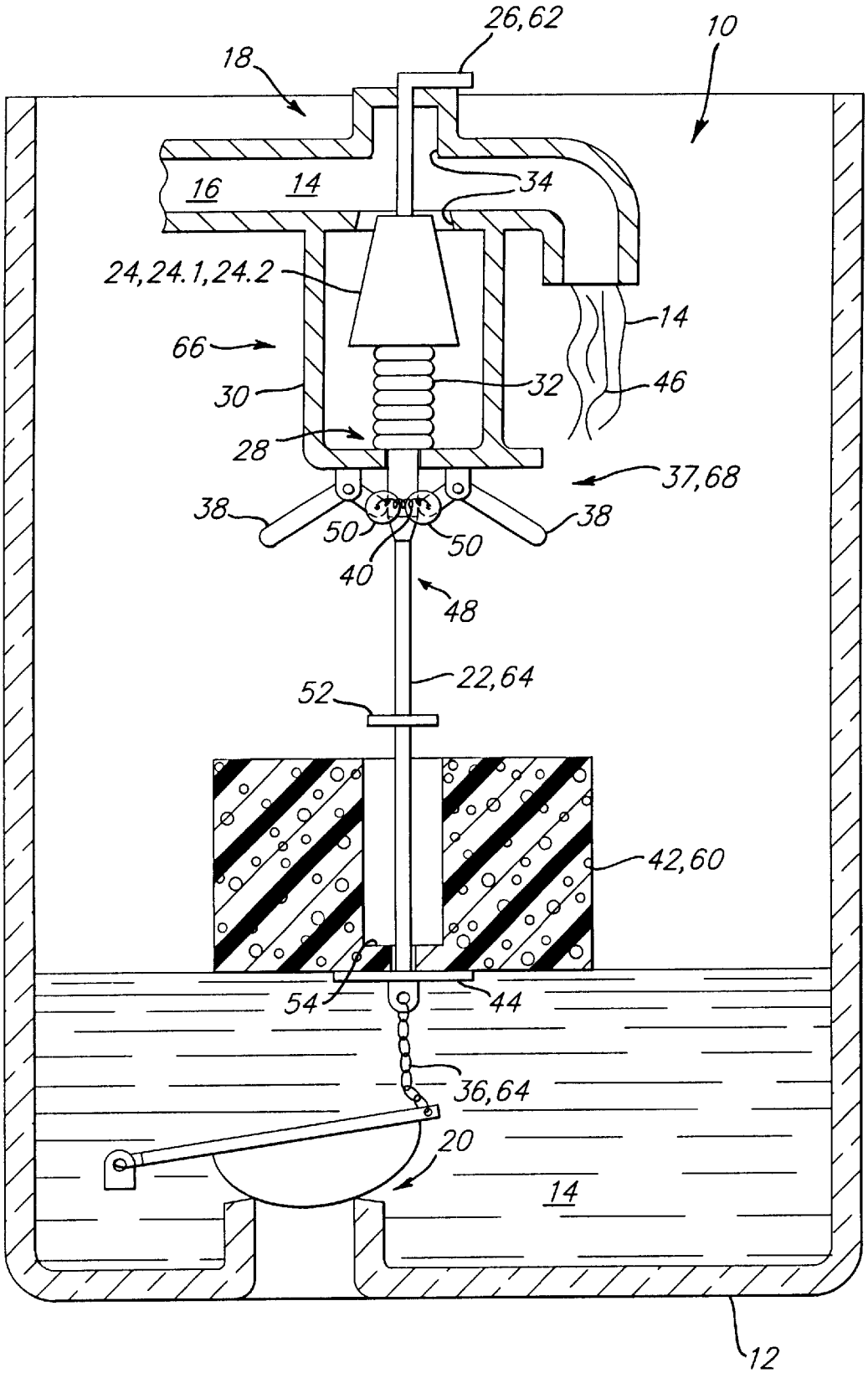
FIG. 2 illustrates the tank fill and discharge mechanism in a fill cycle, with the fluid inlet valve open, the tank discharge valve closed, and the tank filling with fluid.

In operation, referring to FIG. 2, the handle 26 is depressed against the action of the first biasing spring 32, thereby opening the fluid inlet valve 18 and closing the tank discharge valve 20. The pawls 38, biased for example by at least one second biasing spring 40, engage the rod 22 so as to hold the fluid inlet valve 18 open and the tank discharge valve 20 closed, thereby enabling a fluid stream 46 from the source of fluid 16 through the fluid inlet valve 18 to fill the tank 12.

Figure 3:
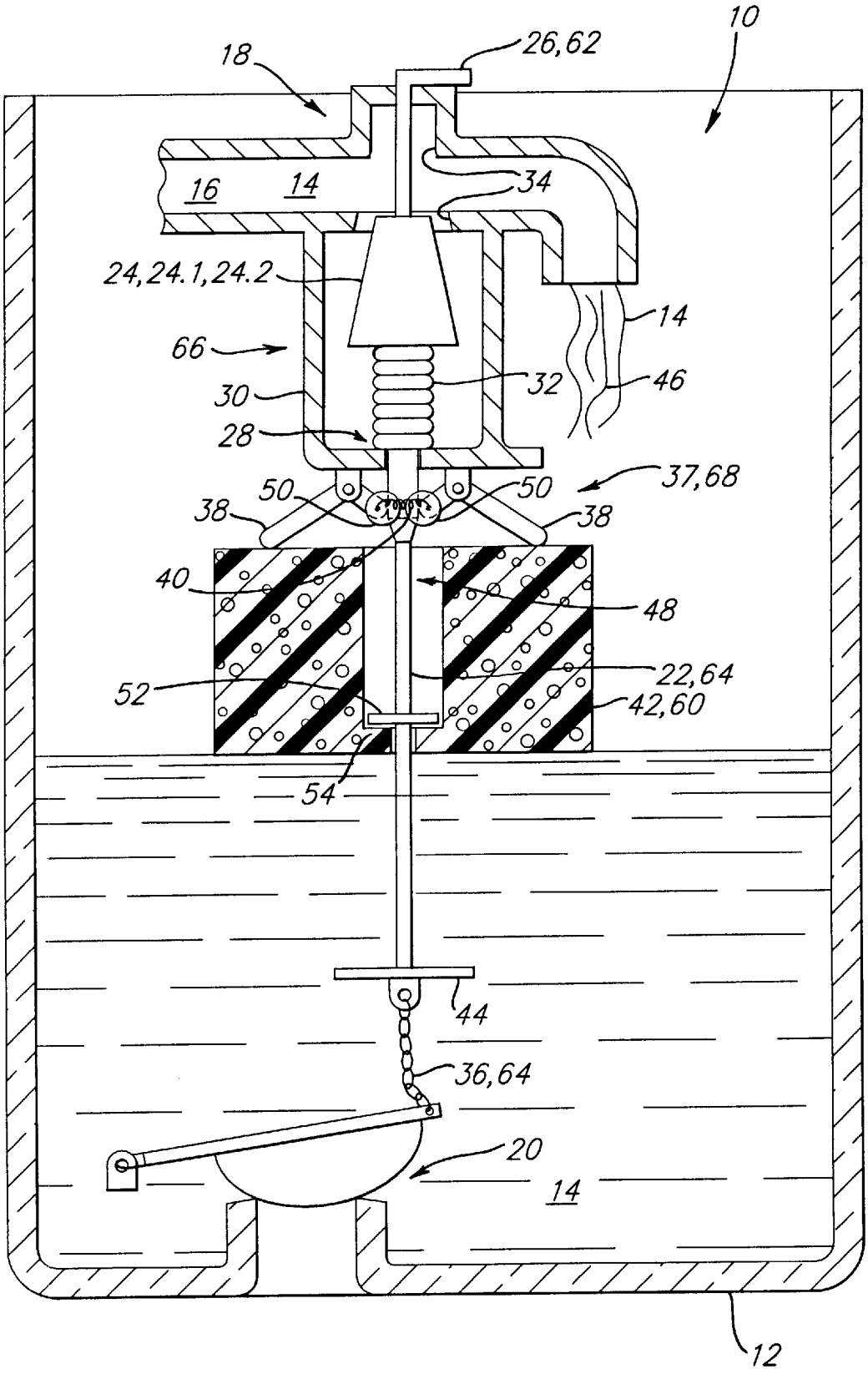
FIG. 3 illustrates the tank fill and discharge mechanism just prior to the beginning of a discharge cycle, with the fluid inlet valve open, the tank discharge valve closed, the tank filled with a volume of fluid, and the float about to release the pawls that engage a rod that holds the fluid inlet valve open and the tank discharge valve closed.
Figure 4:
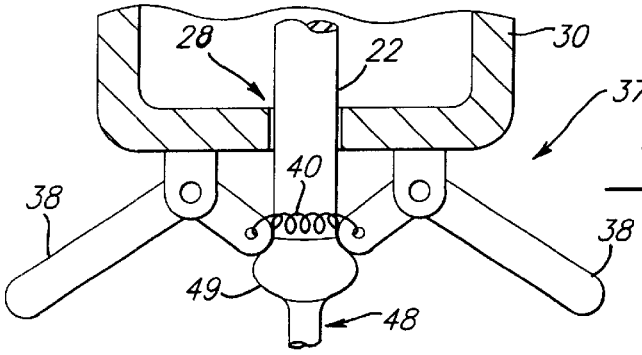
FIG. 4 illustrates a first alternative example of an arrangement for facilitating release of engagement of the rod by the pawls.
Figure 5A:
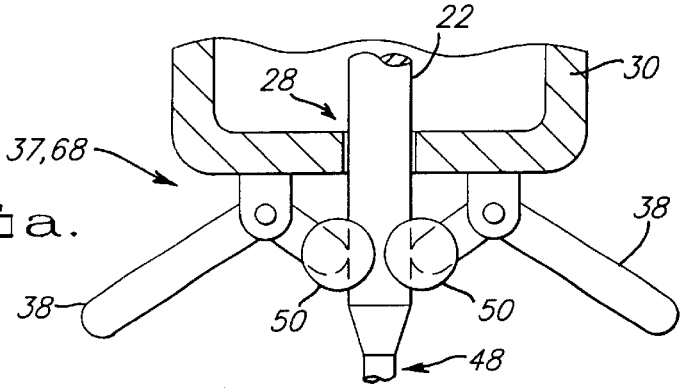
FIG. 5*a* illustrates a second alternative example of an arrangement for facilitating release of engagement of the rod by the pawls, showing the pawls engaged with the rod.
Figure 5B:
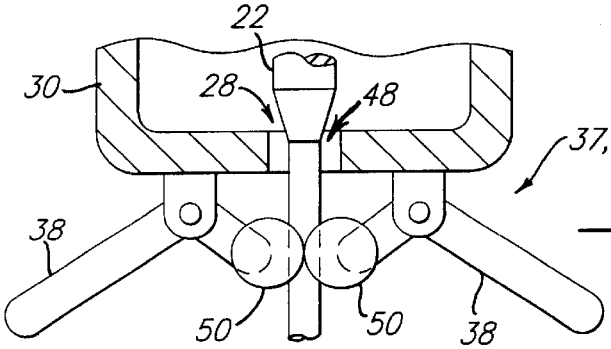
FIG. 5*b* illustrates the second alternative example of an arrangement for facilitating release of engagement of the rod by the pawls; showing the pawls not engaged with the rod.
Figure 5C:
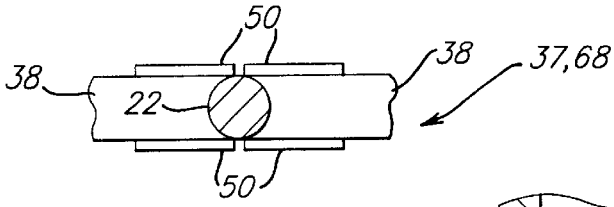
FIG. 5*c* illustrates the a top view of the arrangement of FIG. 5*a*.

Referring to FIG. 3, as the tank fills, the float 42 disposed about the rod 22 rises and ultimately contacts the pawls 38. When the fluid level is sufficiently high, the buoyancy force transmitted by the float 42 is sufficient to release the pawls 38 from engagement with the rod 22, thereby releasing the rod 22 to move in the direction of biasing by the first biasing spring 32, closing the fluid inlet valve 18 and opening the tank discharge valve 20, which discharges fluid 14 from the tank 12 through the tank discharge valve 20, thereby returning the tank to the normally-discharged state illustrated in FIG. 1. The rod 22 can be shaped or tapered to as to provide for improved release by the pawls 38. For example, FIGS. 1–3 illustrate a reduced section 48 of the rod 22 for this purpose. Referring to FIG. 4, in a first alternative example of an arrangement, the rod 22 is adapted so that the pawls 38 act against a expanded section 49 of the rod 22 when holding the fluid inlet valve 18 open, wherein the rod 22 is tapered below the expanded section 49 so that after the rod 22 is initially released, the gripping force of the pawls 38 is substantially reduced, thereby enabling the rod 22 to be released from engagement by the pawls 38 as the fluid level drops and the resulting buoyancy force from the float 42 is reduced. Referring to FIGS. 5*a–c*, in second alternative example of an arrangement, the pawls 38 are adapted with lips 50 which prevent engagement by the pawls 38 of the reduced section 48 of the rod 22, but which do not interfere with engagement elsewhere on the rod 22. The tapering or shaping of the rod 22 can be different for different directions of the handle 26. For example, the rod 22 can be shaped such the with the handle rotated by 90 degrees from the normal position the fluid inlet valve 18 and tank discharge valve 20 are manually and directly controlled responsive to the depressing or releasing of the handle 26.

The rod 22 can be provided with a second flange 52 that is engaged by a lip 54 on the float 42, whereby after the float releases the pawls 38 from engagement with the rod 22, if the tank discharge valve 20 is not opened, the force of buoyancy on the float 42 causes the lip 54 on the float 42 to engage the second flange 52 on the rod 22 so as to augment the process of releasing the rod 22 from engagement by the pawls 38 to open the tank discharge valve 20 and to close the fluid inlet valve 18, thereby preventing the tank from overflowing. In the event of a failure of the chain 36, causing the tank discharge valve 20 to remain closed, the tank 12 will remain full of fluid. In the event of a simultaneous failure of the first biasing spring 32, the action of the float 42 against the lip 54 will close the fluid inlet valve 18, thereby preventing the tank from overflowing.

Figure 6:
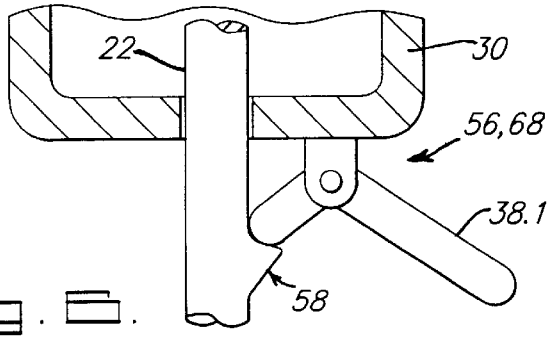
FIG. 6 illustrates an example of a latch mechanism comprising a pawl for releasably engaging a lip on a rod.

Referring to FIG. 6, illustrating another example of a means for releasably engaging the rod 22, a latch mechanism 56 comprises a pawl 38.1 that releasably engages a lip 58 on the rod 22. The curvatures of the lip 58 and pawl 38.1 at the region of engagement can be made similar to facilitate disengagement. The pawl 38.1 is biased into engagement with the lip 58, for example by gravity as illustrated, or by a separate biasing element such as a spring.

The tank fill and discharge mechanism 10 illustrated herein can be integrated with the fluid inlet valve 18. For example, the fluid inlet valve 18, rod 22, first biasing spring 32, and the clamp mechanism 37 or latch mechanism 56 can be provided in a single assembly, possibly also integrated with the handle 26 and the float 42, so as to improve reliability and reduce cost.

The tank fill and discharge mechanism 10 is suited for application to toilet flush tanks, so as to avoid condensation on the sides of a tank 12 that could otherwise occur if water were standing in the tank 12, to avoid wasting water from a leaky tank discharge valve 20, or to avoid heat transfer between the fluid 14 in the tank and the surroundings.

In general, a nomally-full toilet tank flushing mechanism can be converted to a normally-discharged tank fill and discharge mechanism in accordance with the teachings herein. For example, a toilet with a normally-full toilet tank flushing mechanism comprises a tank 12, a fluid Inlet valve 18, a tank discharge valve 20, a float element 60, and an activation element 62 (for example a handle mechanism comprising a handle and a lever), wherein the float element 60 is operatively coupled to the fluid inlet valve 18, for example by an associated mechanism, and the activation element 62 comprising a handle and lever, is operatively coupled to the tank discharge valve 20, for example with a chain. With the tank discharge valve 20 closed, the tank 12 fills with water from the fluid inlet valve 18 causing the float element 60 to rise, until the tank 12 becomes full, at which time the float element 60 causes the fluid Inlet valve 18 to shut off. The tank 12 is then discharged when the activation element 62 is activated, for example by depressing the associated handle, so as to cause the tank discharge valve 20 to open, which discharges the tank 12, thereby lowering the water level therein which lowers the float element 60, which in turn causes the fluid inlet valve 18 to open, thereby refilling the tank 12 with water as described hereinabove. (It should be noted that the normally-full toilet tank flushing mechanism is not illustrated in the accompanying drawings but would be familiar to one of ordinary skill in the art.

Although reference is made in the description thereof hereinabove to the elements of the instant invention for purposes of comparison, it should be understood that these elements would be interconnected in a different way for a normally-full toilet tank flushing mechanism than described and illustrated herein for a normally-discharged tank fill and discharge mechanism.) The above-described normally-full toilet tank flushing mechanism can be converted to a normally-discharged tank fill and discharge mechanism by the following steps:

1. Couple the tank discharge valve 20 to the fluid inlet valve 18 with a coupling element 64 such that when the tank discharge valve 20 is closed, the coupling element 64 causes the fluid inlet valve 18 to open, and when the fluid inlet valve 18 is closed, the coupling element 64 causes the tank discharge valve 20 to open;

2. Provide a biasing element 66, for example a spring or weight, to bias the fluid inlet valve 18 closed;

3. Operatively couple the activation element 62 to the fluid inlet valve 18, the coupling element 64, or the tank discharge valve 20, so that when the activation element 62 is activated the fluid inlet valve 18 is opened and the tank discharge valve 20 is closed;

4. Provide a retaining element 68 operatively coupled to the fluid inlet valve 18, the coupling element 64, or the tank discharge valve 20, to retain—against the action of the biasing element 66—the fluid inlet valve 18 open and the tank discharge valve 20 closed when the fluid inlet valve 18 is opened by the activation element 62; and 5. Adapt the float element 60 and the retaining element 68 so that the float element 60 releases the retaining element 68 when the fluid level in the tank 12 is sufficient to flush the toilet.

The instant invention may also be beneficially used in applications requiring a metered amount of fluid from a tank, that if left standing would be subject to undesirable change in properties, such as by heat transfer or evaporation to the surroundings, or by chemical change. While the instant invention is particularly suited to controlling the fill and discharge of water to and from a toilet tank, it will be understood by one with ordinary skill in the art that the instant invention can also be applied to controlling the fill and discharge of any fluid from a tank that is normally-discharged and which is to be filled with and discharged of a volume of fluid responsive to the activation of the mechanism.

While specific embodiments have been described in detail, those with ordinary skill in the art will appreciate that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

I claim:

1. A tank filling and discharge mechanism, comprising:

(a) an inlet valve comprising a housing, a valve seat, and a first valve element moveable relative to said valve seat for opening and closing said inlet valve, wherein said inlet valve is operatively coupleable to a tank and to a source of fluid, whereby when said inlet valve is operatively coupled to said tank and to said source of fluid, said inlet valve admits said fluid to said tank when said inlet valve is open;

(b) a discharge valve comprising a second moveable valve element, wherein said discharge valve is operatively coupleable to said tank, whereby when said discharge valve is operatively coupled to said tank and said discharge valve is opened, said fluid can discharge from said tank through said discharge valve;

(c) a coupling element operatively coupled to said first moveable valve element of said inlet valve and to said second moveable valve element of said discharge valve so that when said discharge valve is closed, said inlet valve is open; and when said inlet valve is closed, said discharge valve is open;

(d) an activation element operatively coupled to at least one of said coupling element, said inlet valve, and said discharge valve, whereby when activated, said activation element causes said inlet valve to open and said discharge valve to close;

(e) a first biasing element operatively coupled to at least one of said inlet valve, said coupling element and said discharge valve, whereby said first biasing element applies a biasing force to close said inlet valve;

(f) a retaining element operatively coupled to at least one of said inlet valve, said coupling element, and said discharge valve, wherein said retaining element comprises a clamp mechanism that releasably engages said at least one of said inlet valve, said coupling element, and said discharge valve; and (g) a float, wherein said float is moveable relative to said coupling element; a position of said float is responsive to a fluid level in the tank; for said position below a first position, when said discharge valve is closed, said retaining element engages at least one of said inlet valve, said coupling element, and said discharge valve, so as to prevent said inlet valve from closing and said discharge valve from opening; for said position above said first position, said float engages said retaining element so as to cause said retaining element to release said at least one of said inlet valve, said coupling element, and said discharge valve, thereby enabling said first biasing element to close said inlet valve and open said discharge valve.

2. A tank filling and discharge mechanism as recited in claim 1, wherein said first biasing element comprises a spring.

3. A tank filling and discharge mechanism as recited in claim 1, wherein said coupling element comprises a rod operatively coupled between said first valve element of said inlet valve said second valve element of said discharge valve, and said clamp mechanism comprises at least one pawl that clamps said at least one of said inlet valve, said coupling element and said discharge valve.

4. A tank filling and discharge mechanism, comprising:

(a) an inlet valve comprising a housing, a valve seat, and a first valve element moveable relative to said valve seat for opening and closing said inlet valve, wherein said inlet valve is operatively coupleable to a tank and to a source of fluid, whereby when said inlet valve is operatively coupled to said tank and to said source of fluid, said inlet valve admits said fluid to said tank when said inlet valve is open;

(b) a discharge valve comprising a second moveable valve element, wherein said discharge valve is operatively coupleable to said tank, whereby when said discharge valve is operatively coupled to said tank and said discharge valve is opened, said fluid can discharge from said tank through said discharge valve;

(c) a coupling element operatively coupled to said first moveable valve element of said inlet valve and to said second moveable valve element of said discharge valve so that when said discharge valve is closed, said inlet valve is open; and when said inlet valve is closed, said discharge valve is open;

(d) an activation element operatively coupled to at least one of said coupling element, said inlet valve, and said discharge valve, whereby when activated, said activation element causes said inlet valve to open and said discharge valve to close;

(e) a first biasing element operatively coupled to at least one of said inlet valve, said coupling element and said discharge valve, whereby said first biasing element applies a biasing force to close said inlet valve;

(f) a retaining element operatively coupled to at least one of said inlet valve, said coupling element, and said discharge valve, wherein said coupling element comprises a rod operatively coupled between said first valve element of said inlet valve said second valve element of said discharge valve, said retaining element comprises a clamp mechanism that releasably engages said at least one of said inlet valve, said coupling element, and said discharge valve, said clamp mechanism comprises at least one pawl that clamps said at least one of said inlet valve, said coupling element and said discharge valve, and said clamp mechanism comprises a plurality of pawls; and (g) a float, wherein said float is moveable relative to said coupling element; a position of said float is responsive to a fluid level in the tank; for said position below a first position, when said discharge valve is closed, said retaining element engages at least one of said inlet valve, said coupling element, and said discharge valve, so as to prevent said inlet valve from closing and said discharge valve from opening; for said position above said first position, said float engages said retaining element so as to cause said retaining element to release said at least one of said inlet valve, said coupling element, and said discharge valve, thereby enabling said first biasing element to close said inlet valve and open said discharge valve.

5. A tank filling and discharge mechanism as recited in claim 3, wherein said clamp mechanism comprises at least one second biasing element that biases said at least one pawl against said coupling element so as to retain said coupling element in a position that holds said inlet valve open when said pawl is not engaged by said float.

6. A tank filling and discharge mechanism as recited in claim 3, wherein a section of said rod is increased to facilitate engagement of said retaining element with said rod when said rod is positioned to close said discharge valve.

7. A tank filling and discharge mechanism as recited in claim 3, wherein a section of said rod is decreased to facilitate disengagement of said retaining element from said rod by said float.

8. A tank filling and discharge mechanism as recited in claim 1, wherein said float is disposed about said coupling element.

9. A tank filling and discharge mechanism as recited in claim 3, wherein said float is disposed about said coupling element, and said rod comprises a first flange that provides support for said float when the fluid in the tank is below a first level.

10. A tank filling and discharge mechanism, comprising:

(a) an inlet valve comprising a housing, a valve seat, and a first valve element moveable relative to said valve seat for opening and closing said inlet valve, wherein said inlet valve is operatively coupleable to a tank and to a source of fluid, whereby when said inlet valve is operatively coupled to said tank and to said source of fluid, said inlet valve admits said fluid to said tank when said inlet valve is open;

(b) a discharge valve comprising a second moveable valve element, wherein said discharge valve is operatively coupleable to said tank, whereby when said discharge valve is operatively coupled to said tank and said discharge valve is opened, said fluid can discharge from said tank through said discharge valves (c) a coupling element operatively coupled to said first moveable valve element of said inlet valve and to said second moveable valve clement of said discharge valve so that when said discharge valve is closed, said inlet valve is open; and when said inlet valve is closed, said discharge valve Is open, wherein said coupling element comprises a rod operatively coupled between said first valve element of said inlet valve and said second valve element of said discharge valve, and said rod comprises a second flange, (d) an activation element operatively coupled to at least one of said coupling element, said inlet valve, and said discharge valve, whereby when activated, said activation element causes said inlet valve to open and said discharge valve to close;

(e) a first biasing element operatively coupled to at least one of said inlet valve, said coupling element and said discharge valve, whereby said first biasing element applies a biasing force to close said inlet valve;

(f) a retaining element operatively coupled to at least one of said inlet valve, said coupling element, and said discharge valve, wherein said retaining element comprises a clamp mechanism that releasably engages said at least one of said inlet valve, said coupling element, and said discharge valve; and (g) a float, wherein said float is disposed about said coupling element, said float is moveable relative to said coupling element; a position of said float is responsive to a fluid level in the tank; for said position below a first position, when said discharge valve is closed, said retaining element engages at least one of said inlet valve, said coupling element, and said discharge valve, so as to prevent said inlet valve from closing and said discharge valve from opening; for said position above said first position, said float engages said retaining element so as to cause said retaining element to release said at least one of said inlet valve, said coupling element, and said discharge valve, thereby enabling said first biasing element to close said inlet valve and open said discharge valve, said float comprises a first lip, and said second flange and said first lip are adapted so that said first lip engages said second flange when said float is above said first position, so as to increase said biasing force against said first valve element.

11. It A tank filling and discharge mechanism as recited in claim 1, wherein said coupling element further comprises a flexible link operatively coupled to said discharge valve.

12. A tank filling and discharge mechanism as recited in claim 1, further comprising a tank, wherein said inlet valve and said discharge valve are operatively coupled to said tank, and said activation element comprises a handle mechanism.

13. A tank filling and discharge mechanism as recited in claim 1, wherein said activation element is operatively coupled to at least one of said coupling element and said inlet valve, said first biasing element is operatively coupled to at least one of said inlet valve and said coupling element, and said retaining element is operatively coupled to said coupling element, wherein said retaining element comprises a clamp mechanism that releasably engages said coupling element.

14. A tank filling and discharge mechanism as recited in claim 13, wherein said first biasing element is operatively coupled to said inlet valve.

15. A tank filling and discharge mechanism, comprising:

(a) an inlet valve comprising a housing, a valve seat and a first valve element moveable relative to said valve seat for opening and closing said inlet valve, wherein said inlet valve is operatively coupleable to a tank and to a source of fluid, whereby when said inlet valve is operatively coupled to said tank and to said source of fluid, said inlet valve admits said fluid to said tax when said inlet valve is open;

(b) a discharge valve comprising a second moveable valve element, wherein said discharge valve is operatively coupleable to said tank, whereby when said discharge valve is operatively coupled to said tank and said discharge valve is opened, said fluid can discharge from said tank through said discharge valve;

(c) a coupling element operatively coupled to said first moveable valve element of said inlet valve and to said second moveable valve element of said discharge valve so that when said discharge valve is closed, said inlet valve is open, and when said inlet valve is closed, said discharge valve is open, wherein said coupling element comprises a rod operatively coupled between said first valve element of said inlet valve said second valve element of said discharge valve, whereby said first and second moveable valve elements are moved by a translation of said rod;

(d) an activation element operatively coupled to at least one of said coupling element, said inlet valve, and said discharge valve, whereby when activated, said activation element causes said inlet valve to open and said discharge valve to close;

(e) a first biasing element operatively coupled to at least one of said inlet valve, said coupling element and said discharge valve, whereby said first biasing element applies a biasing force to close said inlet valve, (f) a retaining element operatively coupled to said rod, wherein said retaining element is comprises a latch mechanism operatively coupled between said rod and said housing of said inlet valve that releasably engages said coupling element, and (g) a float, wherein said float is moveable relative to said coupling element; a position of said float is responsive to a fluid level in the tank; for said position below a first position, when said discharge valve is closed, said retaining element engages said coupling element so as to prevent said inlet valve from closing aid said discharge valve from opening; for said position above said first position, said float engages said retaining element so as to cause said retaining element to release said coupling element, thereby enabling said first biasing element to close said inlet valve and open said discharge valve.

16. A tank filling and discharge mechanism as recited in claim 15, wherein said rod further comprises a second lip and said latch mechanism comprises a pawl that engages said second lip of said rod when said rod is positioned to close said discharge valve, so as to latch said coupling element.

17. A tank filling and discharge mechanism as recited in claim 15, wherein said first biasing element comprises a spring.

18. A tank filling and discharge mechanism as recited in claim 15, wherein said float is disposed about said coupling element.

19. A tank filling and discharge mechanism as recited in claim 15, further comprising a tank, wherein said inlet valve and said discharge valve are operatively coupled to said tank and said activation element comprises a handle mechanism.

20. A tank filling and discharge mechanism as recited in claim 15, wherein said activation element is operatively coupled to at least one of said coupling element and said inlet valve, said first biasing element is operatively coupled to at least one of said inlet valve and said coupling element.

21. A method of filling a tank with fluid and then discharging the fluid from the tank, comprising;

(a) controlling an inflow of a fluid from a source of fluid into a tank with an inlet valve;

(b) controlling a discharge of said fluid from said tank with a discharge valve;

(c) operatively coupling said inlet valve to said discharge valve so that when said discharge valve is closed, said inlet valve is open; and when said inlet valve is closed, said discharge valve is open;

(d) applying a biasing force so as to tend to close said inlet valve, (e) closing said discharge valve, thereby causing said inlet valve to open by said coupling of said inlet valve to said discharge valve, thereby admitting said fluid to said tank;

(f) providing a clamping force so as to hold said discharge valve closed against said biasing force;

(g) modifying said clamping force responsive to a buoyancy force, whereby when a level of said fluid in said tank is above a threshold, said biasing force is sufficient to overcome said clamping force, thereby closing said inlet valve and opening said discharge valve; and (h) discharging at least a portion of said fluid from said tank through said discharge valve.

22. A method of filling a tank with fluid and then discharging the fluid from the tank, comprising:

(a) controlling an inflow of a fluid from a source of fluid into a tank with an inlet valve;

(b) controlling a discharge of said fluid from said tank with a discharge valve;

(c) operatively coupling said inlet valve to said discharge valve so that when said discharge valve is closed, said inlet valve is open; and when said inlet valve is closed, said discharge valve is open; whereby said inlet valve is opened and said discharge valve is closed by a translation of a coupling element in a first direction; and said inlet valve is closed and said discharge valve is opened by a translation of said coupling element in a second direction opposite to said first direction;

(d) applying a biasing force so as to tend to close said inlet valve;

(e) closing said discharge valve, thereby causing said inlet valve to open by said coupling of said inlet valve to said discharge valve, thereby admitting said fluid to said tank;

(f) providing a latching force so as to hold said discharge valve closed against said biasing force;

(g) modifying said latching force responsive to a buoyancy force, whereby when a level of said fluid in said tank is above a threshold, said latching force is released, thereby enabling said biasing force to close said inlet valve and open said discharge valve: and (h) discharging at least a portion of said fluid from said tank through said discharge valve.

23. A tank filling and discharge mechanism as recited in claim 4, wherein said first biasing element comprises a spring.

24. A tank filling and discharge mechanism as recited in claim 4, wherein said clamp mechanism comprises at least one second biasing element that biases said at least one pawl against said coupling element so as to retain said coupling element in a position that holds said inlet valve open when said pawl is not engaged by said float.

25. A tank filling and discharge mechanism as recited in claim 4, wherein a section of said rod is increased to facilitate engagement of said retaining element with said rod when said rod is positioned to close said discharge valve.

26. A tank filling and discharge mechanism as recited in claim 4, wherein a section of said rod is decreased to facilitate disengagement of said retaining element from said rod by said float.

27. A tank filling and discharge mechanism as recited in claim 4, wherein said float is disposed about said coupling element.

28. A tank filling and discharge mechanism as recited in claim 27, wherein said rod comprises a first flange that provides support for said float when the fluid in the tank is below a first level.

29. A tank filling and discharge mechanism as recited in claim 27, wherein said rod comprises a second flange, said float comprises a first lip, and said second flange and said first lip are adapted so that said first lip engages said second flange when said float is above said first position, so as to increase said biasing force against said first valve element.

30. A tank filling and discharge mechanism as recited in claim 4, wherein said coupling element further comprises a flexible link operatively coupled to said discharge valve.

31. A tank filling and discharge mechanism as recited in claim 4, further comprising a tank, wherein said inlet valve and said discharge valve are operatively coupled to said tank, and said activation element comprises a handle mechanism.

32. A tank filling and discharge mechanism as recited in claim 4, wherein said activation element is operatively coupled to at least one of said coupling element and said inlet valve, said first biasing element is operatively coupled to at least one of said inlet valve and said coupling element, and said retaining element is operatively coupled to said coupling element, wherein said retaining element comprises a clamp mechanism that releasably engages said coupling element.

33. A tank filling and discharge mechanism as recited in claim 32, wherein said first biasing clement is operatively coupled to said inlet valve.

34. A tank filling and discharge mechanism as recited in claim 10, wherein said first biasing element comprises a spring.

35. A tank filling and discharge mechanism as recited in claim 10, wherein said clamp mechanism comprises at least one pawl that clamps said at least one of said inlet valve, said coupling element and said discharge valve.

36. A tank filling and discharge mechanism as recited in claim 10, wherein said clamp mechanism comprises a plurality of pawls.

37. A tank filling and discharge mechanism as recited in claim 10, wherein said clamp mechanism comprises at least one second biasing element that biases said at least one pawl against said coupling element so as to retain said coupling element in a position that holds said inlet valve open when said pawl is not engaged by said float.

38. A tank filling and discharge mechanism as recited in claim 10, wherein a section of said rod is increased to facilitate engagement of said retaining element with said rod when said rod is positioned to close said discharge valve.

39. A tank filling and discharge mechanism as recited in claim 10, wherein a section of said rod is decreased to facilitate disengagement of said retaining element from said rod by said float.

40. A tank filling and discharge mechanism as recited in claim 10, wherein said rod comprises a first flange that provides support for said float when the fluid in the tank is below a first level.

41. A tank filling and discharge mechanism as recited in claim 10, wherein said coupling element further comprises a flexible link operatively coupled to said discharge valve.

42. A tank filling and discharge mechanism as recited in claim 10, further comprising a tank, wherein said inlet valve and said discharge valve are operatively coupled to said tank, and said activation element comprises a handle mechanism.

43. A tank filling and discharge mechanism as recited in claim 10, wherein said activation element is operatively coupled to at least one of said coupling element and said inlet valve, said first biasing element is operatively coupled to at least one of said inlet valve and said coupling element, and said retaining element is operatively coupled to said coupling element, wherein said retaining element comprises a clamp mechanism that releasably engages said coupling element.

44. A tank filling and discharge mechanism as recited in claim 43, wherein said first biasing element is operatively coupled to said inlet valve.

* * * * *